US005752347A

United States Patent [19]

Osborn

[11] Patent Number: 5,752,347

[45] Date of Patent: May 19, 1998

[54] BREAKAWAY GUTTER

[76] Inventor: Arthur Monroe Osborn, P.O. Box 2616, Seward, Ak. 99664

[21] Appl. No.: 620,009

[22] Filed: Mar. 21, 1996

[51] Int. Cl.[6] ..... E04D 13/076

[52] U.S. Cl. ..... 52/11; 52/12; 52/13; 52/14; 52/16; 210/159; 210/153; 138/92

[58] Field of Search ..... 52/11, 12, 13, 52/14, 16; 210/159, 153, 411, 474; 138/92, 156; 248/48.2

[56] References Cited

U.S. PATENT DOCUMENTS

| | | | |
|---|---|---|---|
| 1,313,742 | 8/1919 | Schad . | |
| 4,576,666 | 3/1986 | Harris et al. | 138/156 X |
| 4,669,232 | 6/1987 | Wyatt . | |
| 4,696,131 | 9/1987 | Schreffler | 52/11 |
| 4,725,463 | 2/1988 | Baumber et al. | 138/156 X |
| 4,837,987 | 6/1989 | Fender | 52/11 |
| 4,900,596 | 2/1990 | Peacock | 138/156 X |
| 4,901,954 | 2/1990 | Fairgrieve et al. | 52/11 X |
| 5,146,718 | 9/1992 | Baskett | 52/11 |
| 5,184,435 | 2/1993 | Sherman . | |
| 5,274,965 | 1/1994 | Jackson . | |
| 5,417,015 | 5/1995 | Coyne | 52/11 |
| 5,557,891 | 9/1996 | Albracht | 52/11 X |

*Primary Examiner*—Wynn E. Wood
*Assistant Examiner*—W. Glenn Edwards
*Attorney, Agent, or Firm*—Michael I. Kroll

[57] ABSTRACT

A breakaway gutter (30) comprising a flexible trough (32) having a rearward edge (34) permanently connected to a building (36) proximate an overhanging edge (38) of a roof (40) of the building (36). Structures (42) are connected to the building (36), for retaining in a detachable manner a forward edge (44) of the flexible trough (32), so that the flexible trough (32) will be in a position to receive water from the roof (40) when it rains. The forward edge (44) of the flexible trough (32) can disengage from the retaining structures (42) by pressure exerted by the weight of snow on the roof (40) in winter, to prevent damage to the flexible trough (32).

7 Claims, 4 Drawing Sheets

BREAKAWAY GUTTER

BACKGROUND OF THE INVENTION

1. Field of the Invention

The instant invention relates generally to cleanable rain gutters and more specifically it relates to a breakaway gutter.

2. Description of the Prior Art

Numerous cleanable rain gutters have been provided in prior art. For example, U.S. Pat. Nos. 1,313,742 to Schad; 4,669,232 to Wyatt; 5,184,435 to Sherman and 5,274,965 to Jackson all are illustrative of such prior art. While these units may be suitable for the particular purpose to which they address, they would not be as suitable for the purposes of the present invention as heretofore described.

SCHAD, JACOB

DETACHABLE EAVES TROUGH

U.S. Pat. No. 1,313,742

A detachable eaves trough, containing a gutter of sheet metal or other suitable material, which is so arranged with relation to the projecting edges of the shingles or other covering of the roof as to permit water to freely flow into the gutter. At the same time it prevents a small entrance space to prevent the entrance and nesting of birds in the gutter. It further causes leaves and other refuse to pass over instead of lodging in the gutter. The trough and gutter as a whole may be readily applied and removed, or whereby the outer side of the trough may be detached to free the outer edge of the gutter, allowing all accumulated deposits to be removed in a ready and convenient manner.

WYATT, ROBERT L.

RAIN GUTTER SUPPORTS FOR DUMPING DEBRIS

U.S. Pat. No. 4,669,232

Rain gutter supports are provided, whereby leaves, needles, dirt and other debris, are dumped out of conventional rain gutters, by pivoting these rain gutters upon the initial application of force by hand held tools at ground level. Respective spring like holding clips are cleared of the outside top edge of a rain gutter, allowing the rain gutter to be pivoted about a hinge supported lower inside corner.

SHERMAN, BERNARD

READILY CLEANABLE GUTTER AND GUTTER CONVERSION METHOD

U.S. Pat. No. 5,184,435

A system is provided for converting conventionally hanger-hung gutters fixedly disposed to receive water from building roofs to a gutter system wherein the gutters are selectively movable between water receiving dispositions and overturned dispositions to facilitate dumping debris from the gutters. The system entails securing first portions of gutter mounting brackets in spaced relationship along the length of the gutter proximate the lower edge of the gutter front wall and securing a second portion of the gutter mounting brackets to the building fascia, while the gutters are still secured to the building by the conventional gutter hangers. A pivot pin connects the mounting bracket first and second portions to permit the selective gutter movements. Selective movement of the gutters is effected by use of a rod operated by a person standing on the ground beneath the gutters and the application of force in selected manner to the gutter. The same gutter mounting brackets can also be utilized to mount gutters to buildings in original installations, rather than conversions. The mounting brackets may utilize either a single or a pair of spaced hinge brackets. A flared upper end of a downspout is disposed in proximity to a lead pipe which directs water from the gutters to the downspouts. Rubber gaskets are provided on open ended gutters.

JACKSON, ROBERT W.

INVERTING RAIN GUTTER

U.S. Pat. No. 5,274,965

A gutter bracket assembly includes a fascia bracket and a gutter bracket for rotating a gutter to effect cleaning debris therefrom. The fascia bracket including a rear panel adapted to be affixed vertically to a fascia board, a bottom panel extending from the rear panel, and a receiving portion located at an end of the bottom panel remote from the rear panel and including a first pivot member. The gutter bracket includes a frame member having a second pivot member. There is also provided a mechanism for attaching the first pivot member to the second pivot member for permitting rotation of the gutter bracket about the receiving portion of the fascia bracket, so that the gutter bracket may be rotated between a first, rain-gathering position and a second, inverted position for emptying water and/or debris from the gutter. The gutter bracket includes a mechanism for securing the gutter to the frame member solely by a snap-fit of a portion of the frame about a portion of the gutter.

SUMMARY OF THE INVENTION

A primary object of the present invention is to provide a breakaway gutter that will overcome the shortcomings of the prior art devices.

Another object is to provide a breakaway gutter in which during the summer a flexible trough can be pulled down like a flap from support brackets to dump debris therefrom, and then be pushed back to engage with the support bracket in a water receiving position with a tool from ground level.

An additional object is to provide a breakaway gutter in which during the winter the gutter will disengage from the support brackets automatically from the weight of snow and ice on the roof, thereby preventing damage done to the gutter.

A further object is to provide a breakaway gutter that is simple and easy to use.

A still further object is to provide a breakaway gutter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 7:
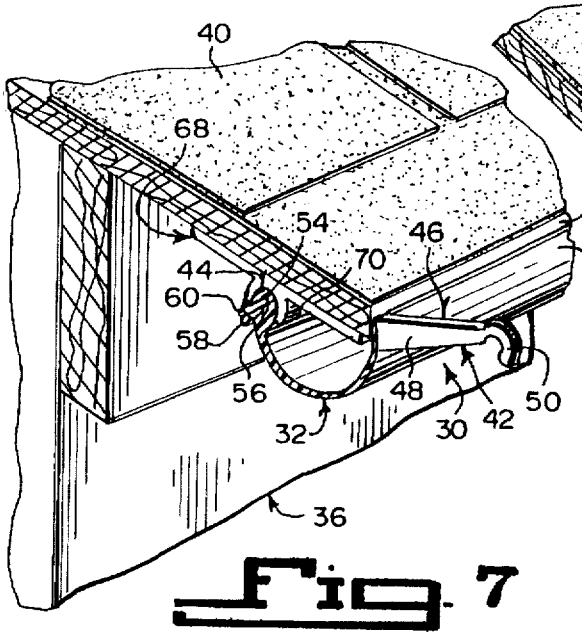

FIG. 7. is a fragmentary perspective view, showing the flexible trough in a stored position, held by a clip holder under the eaves.

Figure 8:
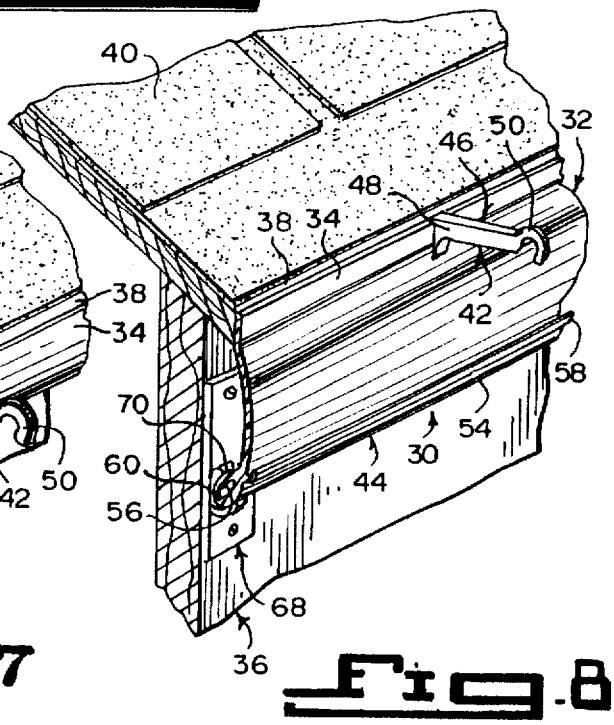

FIG. 8 is a fragmentary perspective view, showing the trough in a stored position, held by a clip holder against the siding of the building.

Figure 9:
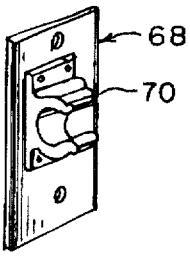

FIG. 9 is perspective view of the clip holder.

Figure 10:
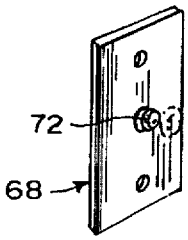

FIG. 10 is a perspective view of a snap holder.

Figure 11:
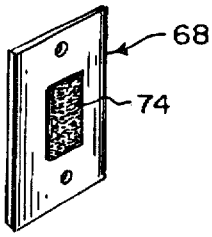

FIG. 11 is a perspective view of a VELCRO holder.

Figure 12:
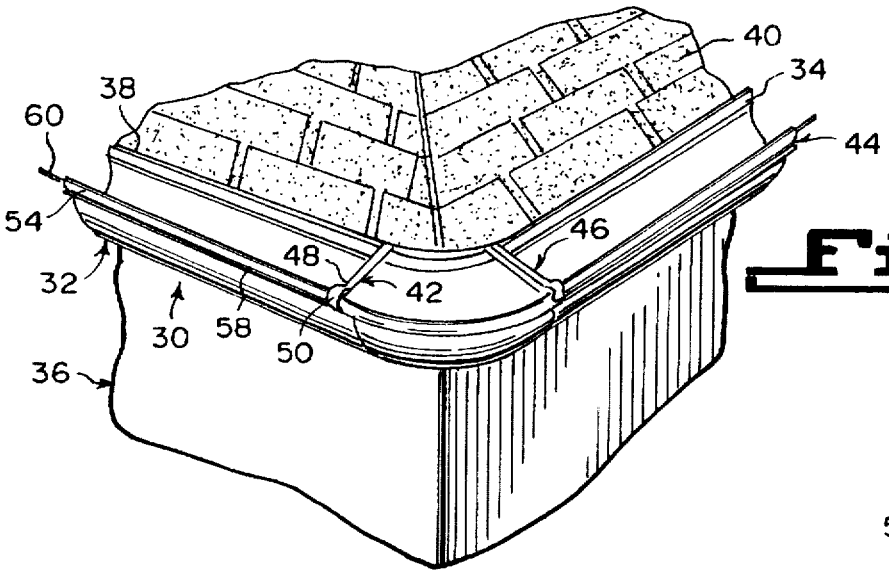

FIG. 12 is a perspective view of a corner piece attachment mounted in place.

Figure 12A:
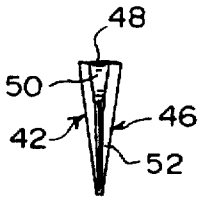

FIG. 12*a* is a front view of one triangular shaped stiff arm support bracket.

Figure 13:
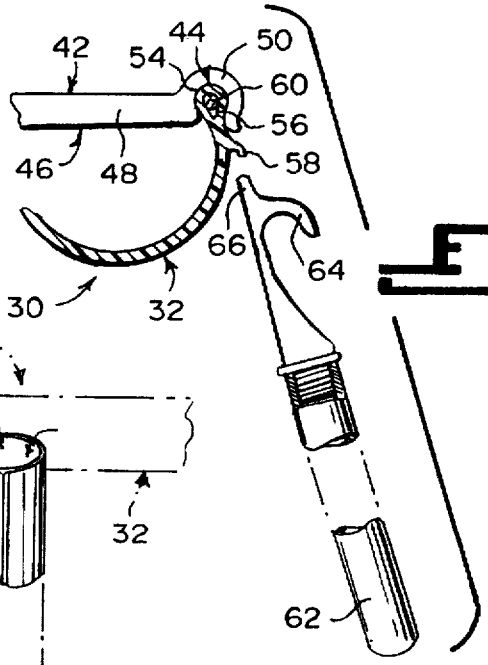

FIG. 13 is a side view with parts broken away, showing a hand held pole used for attaching the trough to the support bracket and detaching the trough from the support bracket.

Figure 14:
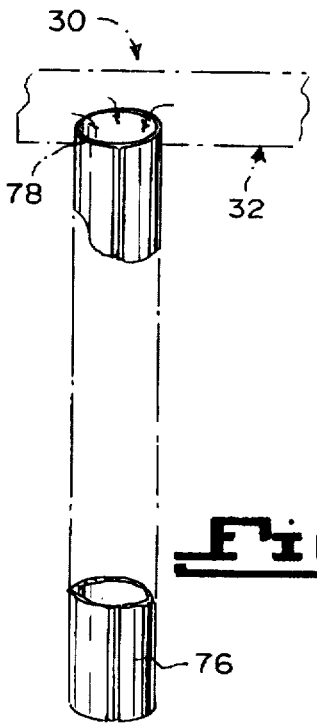

FIG.14 is a diagrammatic phantom view, showing a grate basket used over the top of a downspout.

FIG. is a perspective view with parts broken away and in phantom, showing a zip lock tube downspout.

Similar reference characters denote corresponding features consistently throughout the attached drawings. dr

DETAILED DESCRIPTION OF THE PREFERRED EMBODIMENTS

Figure 1:
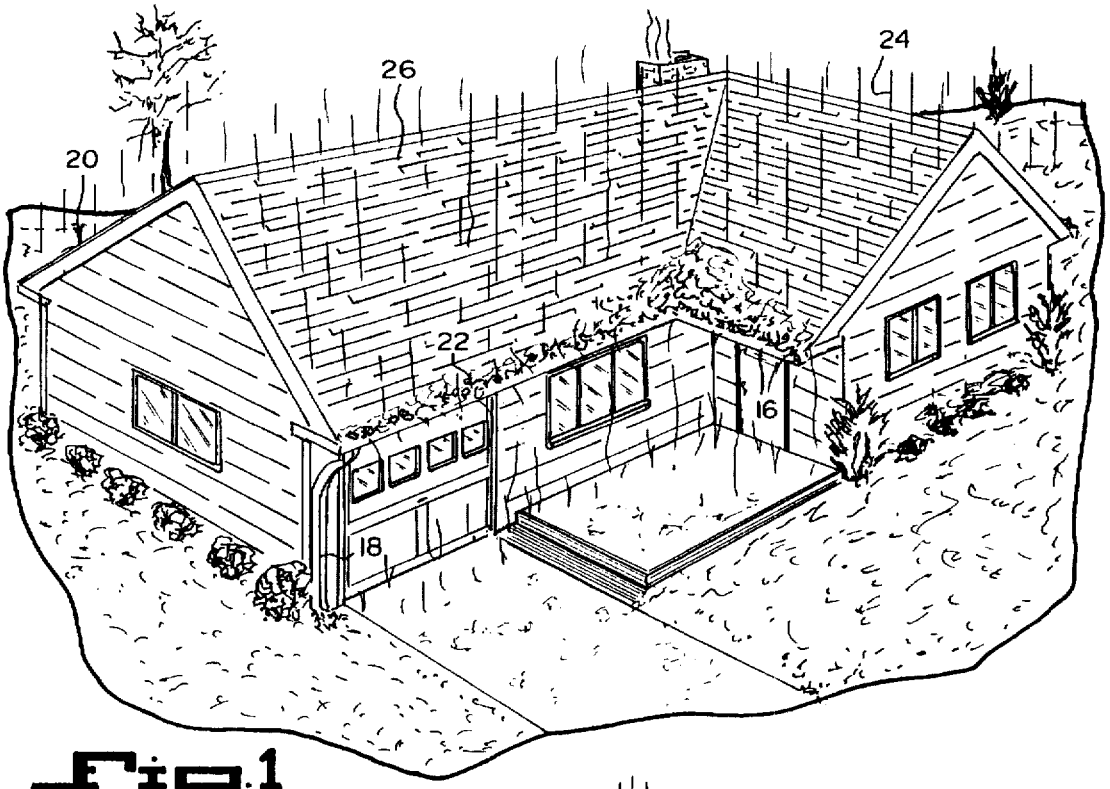
Fig. 1 (PRIOR ART)
FIG. 1 is a perspective view of the prior art, showing the gutters on a house in a summer rain, clogged with debris.
Figure 2:
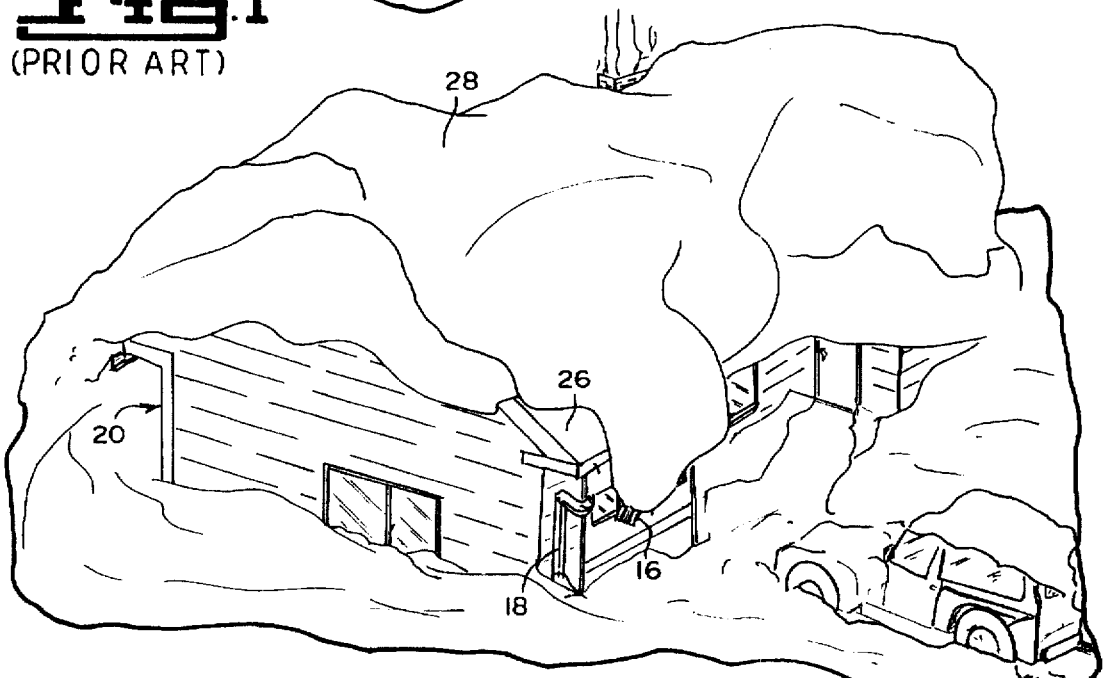
Fig. 2 (PRIOR ART)
FIG. 2 is a perspective view of the prior art, showing the gutters on the house in a winter snow storm collapsed under the weight of the snow.
Figure 3:
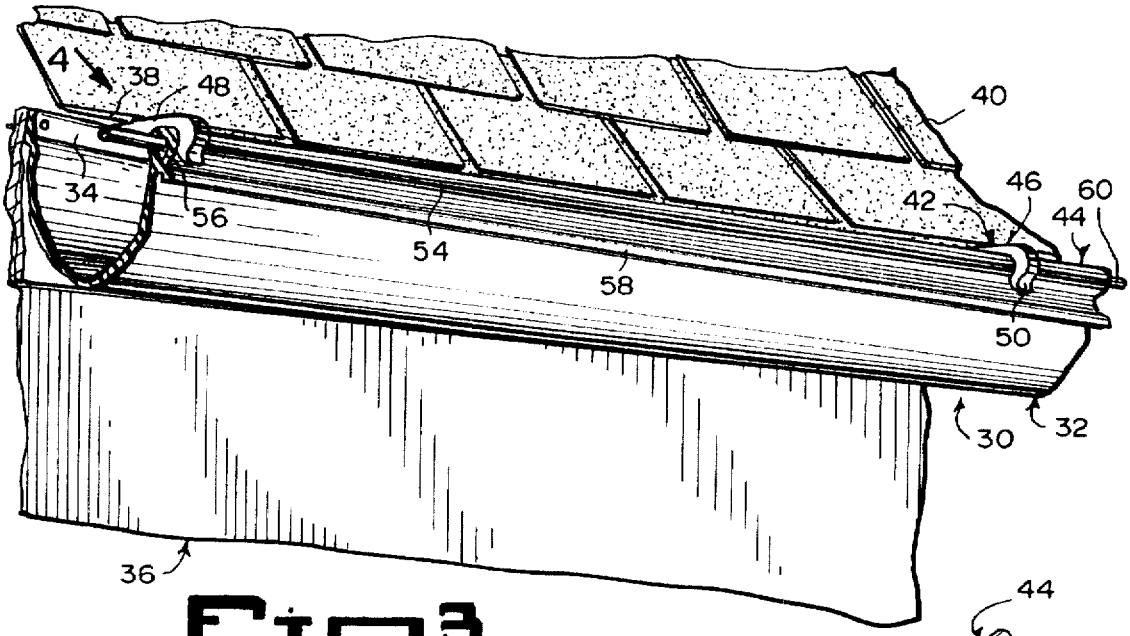
FIG. 3 is a perspective view of a portion of the instant invention installed to a building.

Turning now descriptively to the drawings, in which similar reference characters denote similar elements throughout the several views. FIGS. 1 and 2 illustrate the or art which is a regular rain gutter 16 and downspout 18 mounted to a house 20. In FIG. 1, debris 22 have settled the rain gutter 16, so that any rain water 24 hitting the roof 26 will be prevented from going into the rain gutter 16 and into the downspout 18. In FIG. 2, snow 28 on the roof 26 has damaged the rain gutter 16 and the downspout 18.

FIGS. 3 through 14 shows the instant invention being a breakaway gutter 30, comprising a flexible trough 32 being a rearward edge 34 permanently connected to a building 36 proximate an overhanging edge 38 of a roof 40 of the building 36. Structures 42 are connected to the building 36, for retaining in a detachable manner a forward edge 44 of the flexible trough 32, so that the flexible trough 32 will be in a position to receive water from the roof 40 when it rains. The forward edge 44 of the flexible trough 32 can disengage from the retaining structures 42 by pressure exerted by the weight of snow on the roof 40 in winter, to prevent damage to the flexible trough 32.

Figure 4:
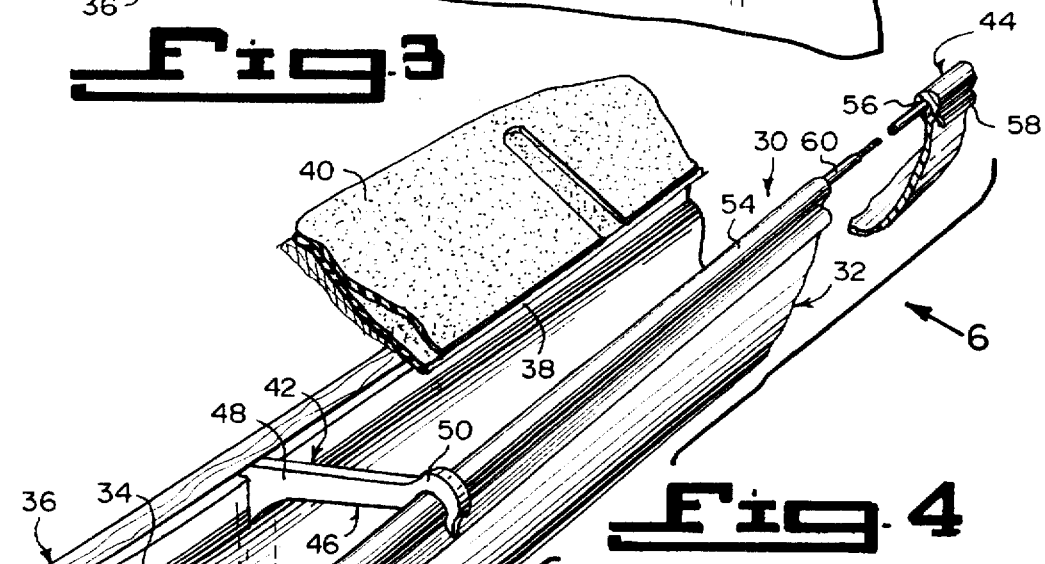
FIG. 4 is a perspective view taken in the direction of arrow 4 in FIG. 3.
Figure 5:
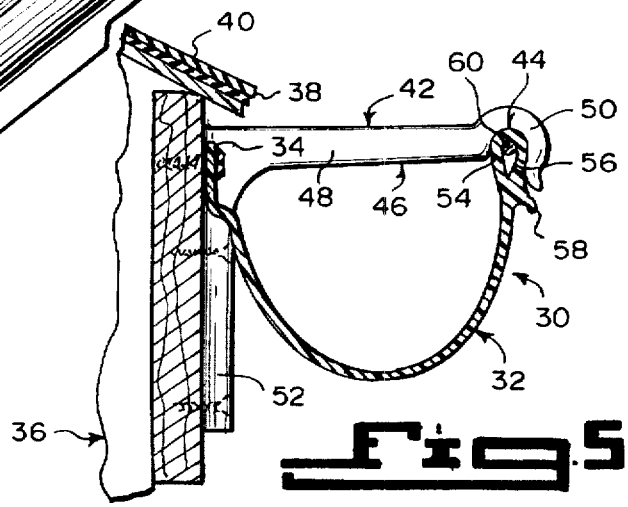
FIG. 5 is an end section view taken in the direction of arrow 5 in FIG. 4.
Figure 6:
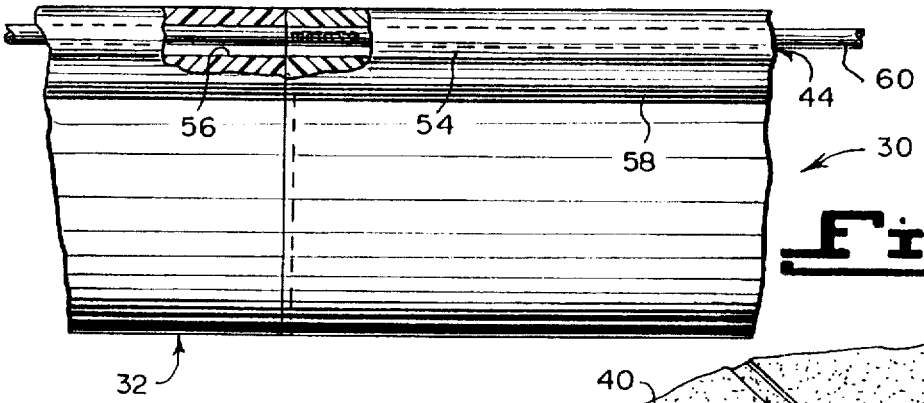
FIG. 6 is a front view with parts broken away, taken in the direction of arrow 6 in FIG. 4, showing the threaded connection of the reinforcement rods to connect the flexible trough sections together.

The retaining structures 42 are a plurality of support brackets 46 spaced apart and extending outwardly from the building 38. Each support bracket 46 can engage with and disengage from the forward edge 44 of the flexible trough 32. Each support bracket 46 includes a rigid arm 48, having a first end connected to the building 38 and a second end with a hook 58 formed thereon, to engage with and disengage from the forward edge 44 of the flexible trough 32. Each support bracket 46 can further include a vertical leg 52 extending from the first end, so that the vertical leg 52 can be connected to the building 36, as shown in FIGS. 4, 5 and 12*a*.

The forward edge 44 of the flexible trough 32 contains a longitudinal beading 54 formed thereon having a bore 56 therethrough. A longitudinal lip 58 is formed on the beading 54. A reinforcement rod 60 is carried within the bore 56 of the beading 54.

As shown in FIG. 13, a pole 62 is provided to be held by a person standing at ground level. The pole 62 has a curved projection 64 at a top end, to pull the beading 54 on the forward edge 44 of the flexible trough 32 away from the retaining structures 42, so as to allow debris to be dumped from the flexible trough 32. A straight projection 66 extends from the top of the curved projection 64 to contact the lip 58 and push the beading 54 on the forward edge 44 of the flexible trough 32 back to the retaining structures 42, to engage therewith and allow the flexible trough 32 to receive the water from the roof 40.

One of a plurality of holders 68, shown in FIG. 7 and 8, is connected to the building 36 proximate the flexible trough 32. When the forward edge 44 of the flexible trough 32 is disengaged from the retaining structures 42 the holders 68 can engage with the forward edge 44, to prevent the flexible trough 32 from blowing and flapping around in windy conditions. In FIG. 7, the holder 68 is connected to the underside of the overhang edge 38 of the roof 40. In FIG. 8 the holder 68 is connected to a side wall of the building 36.

The holder 68 can be a C-clip type mounting plate 70, as best seen in FIG. 9. The holder 68 can be a snap button type mounting plate 72, as shown in FIG. 10. The holder 68 can also be a VELCRO type mounting plate 74, as shown in FIG. 11.

Figure 15:
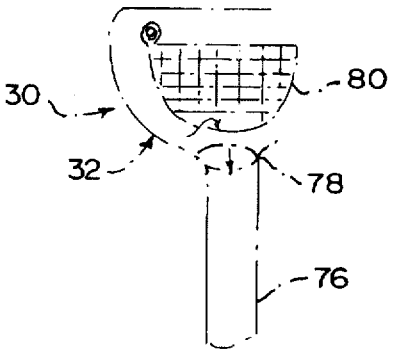

The support bracket 46 in FIG. 12*a*, is triangular shaped to increase its strength. A zip lock tube downspout 76, shown in FIG. 15 extends from an aperture 78 formed in the flexible trough 32, so that the downspout 76 can be opened to clean out debris therefrom.

In FIG. 14, a grate basket 80 is shaped to be placed in the flexible trough 32 over the aperture 78 at the downspout 76. The grate basket 80 will catch debris in the flexible trough 32, before the debris enters the downspout 76.

All of the components of the breakaway gutter 30 for a large house would be able to fit on a four foot by four foot pallet or jobber, instead of needing to ship sections ten feet to twenty feet long. The longest pieces would be the screw in sections of the reinforcement rods 60, being approximately four feet, that are used to stiffen the longitudinal beadings 54 of the forward edges 44 on the flexible troughs 32. This would enable a company to ship three or four times the amount of the product in the same space, or probably much more than that.

The breakaway gutter 30 can easily be colored in order to match with the trim on the house. The support brackets 46 need to be spaced as far apart as the reinforcement rods 60 are long. This will help keep the integrity of the longitudinal beadings 54 of the forward edges 44, plus give added strength to the threaded joints of the reinforcement rods 60.

LIST OF REFERENCE NUMBERS

16 regular rain gutter (prior art)
18 downspout (prior art)
20 house
22 debris in 16
24 rain water
26 roof of 20
28 snow on 16
30 breakaway gutter
32 flexible trough of 30
34 rearward edge of 32
36 building
38 overhanging edge of 40
40 roof on 36
42 retaining structure
44 forward edge of 32
46 support bracket for 42
48 rigid arm of 46
50 hook on 48
52 vertical leg of 46
54 longitudinal beading of 44
56 bore in 54
58 longitudinal lip on 54
60 reinforcement rod in 56
62 pole
64 curved projection on 62
66 straight projection on 64
68 holder
70 C-clip type mounting plate for 68
72 snap button type mounting plate for 68
74 VELCRO type mounting plate for 68
76 zip lock tube downspout
78 aperture in 32
80 grate basket It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A breakaway gutter comprising:

a) a flexible trough having a rearward edge adapted to be permanently connected to a building proximate an overhanging edge of a roof of the building; proximate b) means comprising a plurality of support brackets spaced apart adapted to be connected to the building, each of said brackets comprising a rigid arm with a base at one end for connection to said building and hook means formed in the second end of said arm for retaining in a detachable manner a forward edge of said flexible trough, so that said flexible trough will be in a position to receive water from the roof when it rains when engaged with said brackets, while said forward edge of said flexible trough becomes disengaged from said retaining means by pressure exerted by the weight of snow on the roof in winter, to prevent damage to said flexible trough;

c) said flexible trough including in the forward edge thereof a longitudinal beading formed thereon having a bore therethrough a longitudinal lip formed on said beading, and a reinforcement rod carried within said bore of said beading;

d) means comprising holders adapted to be mounted on said building for engaging the forward edge of said flexible trough when disengaged from said support brackets to prevent said flexible trough from blowing and flapping around in windy conditions, said trough being flexible so as to deform for such engagement.

2. A breakaway gutter as recited in claim 1, wherein each holder is a C-clip type mounting plate.

3. A breakaway gutter as recited in claim 1, wherein each holder is a snap button type mounting plate.

4. A breakaway gutter as recited in claim 1, wherein each holder is a VELCRO type mounting plate.

5. A breakaway gutter as recited in claim 1, wherein each said support bracket is triangular shaped to increase its strength.

6. A breakaway gutter as recited in claim 1, further including a zip lock tube downspout extending from an aperture formed in said flexible trough, so that said downspout can be opened to clean out debris therefrom.

7. A breakaway gutter as recited in claim 6, further including a grate basket shaped to be placed in said flexible trough over said aperture at said downspout, whereby said grate basket will catch debris in said flexible trough before the debris enters said downspout.

* * * * *